US007036248B2

(12) United States Patent
Meyeres et al.

(10) Patent No.: US 7,036,248 B2
(45) Date of Patent: May 2, 2006

(54) PATTERN SELECT VALVE FOR CONTROL LEVERS OF A TITLE WORK VEHICLE

(75) Inventors: Rian Scot Meyeres, Zwingle, IA (US); Kristen Dawn Cadman Bishop, Platteville, WI (US)

(73) Assignee: Deere & Company, Moline, IL (US)

( * ) Notice: Subject to any disclaimer, the term of this patent is extended or adjusted under 35 U.S.C. 154(b) by 206 days.

(21) Appl. No.: 10/693,824

(22) Filed: Oct. 25, 2003

(65) Prior Publication Data

US 2005/0097787 A1 May 12, 2005

(51) Int. Cl.
*E01H 5/04* (2006.01)
*B60K 26/00* (2006.01)

(52) U.S. Cl. ..... 37/348; 37/234; 180/333; 180/334; 172/2

(58) Field of Classification Search ..... 37/348, 37/234, 236, 414, 415; 180/33, 334; 701/50; 172/2, 7, 4, 4.5
See application file for complete search history.

(56) References Cited

U.S. PATENT DOCUMENTS

| | | | | |
|---|---|---|---|---|
| 3,272,280 | A | 9/1966 | Schuetz | |
| 4,646,778 | A | 3/1987 | Tsuji et al. | |
| 4,664,220 | A | 5/1987 | Ruhter et al. | |
| 4,898,078 | A | 2/1990 | Gage et al. | |
| 4,934,462 | A | 6/1990 | Tatara et al. | |
| 4,949,805 | A * | 8/1990 | Mather et al. | 180/333 |
| 5,110,253 | A | 5/1992 | Ernst et al. | |
| 5,138,756 | A | 8/1992 | Johnson et al. | |
| 5,553,992 | A | 9/1996 | Ashcroft | |
| 5,662,005 | A | 9/1997 | Garman | |
| 6,289,783 | B1 | 9/2001 | Sagaser et al. | |
| 6,295,746 | B1 * | 10/2001 | Meduna et al. | 37/382 |
| 6,435,289 | B1 * | 8/2002 | Hori et al. | 180/6.3 |
| 6,481,950 | B1 | 11/2002 | Stickney et al. | |
| 6,499,205 | B1 | 12/2002 | Laffan | |
| 6,601,670 | B1 | 8/2003 | Kaneda et al. | |
| 2003/0010196 | A1 * | 1/2003 | Smith et al. | 91/536 |

FOREIGN PATENT DOCUMENTS

| | | |
|---|---|---|
| GB | 48277/66 | 10/1966 |
| JP | 03003121 | 1/1991 |
| JP | 2001069098 | 3/2001 |

* cited by examiner

*Primary Examiner*—Thomas A Beach
(74) *Attorney, Agent, or Firm*—The Law Office of Randall T. Erickson, P.C.

(57) ABSTRACT

A backhoe control pattern selection arrangement is provided for a backhoe controlled by two control levers. The two levers are operatively connected to hydraulic systems that operate the boom and crowd hydraulic cylinders. An electrically operated valve block is electrically connected to a source of power and to a control switch, and hydraulically connected to the hydraulic systems. Changing the state of the control switch actuates the valve block and modifies the hydraulic systems to reverse the correspondence between the control levers and the boom and crowd functions.

19 Claims, 7 Drawing Sheets

"BACKHOE PATTERN"

"SAE" OR "EXCAVATOR PATTERN"

BACKHOE POSITION

EXCAVATOR POSITION

PATTERN SELECT VALVE FOR CONTROL LEVERS OF A TITLE WORK VEHICLE

TECHNICAL FIELD OF THE INVENTION

The present invention relates to work vehicles having excavating buckets, such as backhoes and excavators. Particularly, the invention relates to work vehicles having excavating buckets that control movement of said excavating bucket through the use of two control levers or joysticks.

BACKGROUND OF THE INVENTION

In operating a work vehicle, such as a backhoe, the operator controls a plurality of work operations through manipulating various control levers that control the positioning of hydraulic control valves. The hydraulic control valves in turn regulate the flow of hydraulic fluid to hydraulic cylinders that manipulate the work implement. When operating the backhoe, the operator turns his seat to face rearward. The operator uses control levers to manipulate the boom relative to the tractor, the dipperstick relative to the boom and the bucket relative to the dipperstick.

On some backhoes the operator controls the backhoe by operating two control levers. Such a backhoe is disclosed in U.S. Pat. No. 6,481,950, herein incorporated by reference. The control levers extend upwardly through a control console located in the rear of the operators cab. The control levers are operatively coupled to a control linkage that manipulates hydraulic control valves in response to movement of the control lever. In the above described control configuration, each control lever controls two hydraulic control valves. Each hydraulic control lever controls one backhoe function by extending and retracting the appropriate hydraulic cylinder or cylinders.

In one control configuration, fore-and-aft movement of the left hand control lever lowers and raises the boom. This movement is sometimes referred to as "boom." Side-to-side movement of the left hand control lever moves the boom side-to-side. This movement is sometimes referred to as "swing." Fore-and-aft movement of the right hand control lever pivots the dipperstick relative to the boom. These movements are sometimes referred to as "crowd." Side-to-side movement of the right hand control lever curls and uncurls the bucket relative to the dipperstick. This movement is sometimes referred to as "curl" or "bucket." This overall operating pattern is referred to as a "backhoe pattern" as shown in FIG. 5.

On other backhoes, the operator controls the backhoe by operating two control levers, but the control functions corresponding to the fore and aft movements of the right and left control levers are reversed. In this control configuration, fore-and-aft movement of the right hand control lever lowers and raises the boom. Side-to-side movement of the right hand control lever remains the same, it curls and uncurls the bucket relative to the dipperstick. Fore-and-aft movement of the left hand control lever pivots the dipperstick relative to the boom. Side-to-side movement of the left hand control lever remains the same, it moves the boom side-to-side. This overall operating pattern is referred to as an "SAE pattern" or "excavator pattern" as shown in FIG. 5.

Although it is possible to purchase a backhoe with the operating pattern of choice, the operating pattern cannot be easily changed in the field. Furthermore, some backhoe owners employ several operators who share the use of one backhoe and each operator may be accustomed to a different operating pattern.

Some heretofore known backhoes have had the capability to switch between patterns. But such switching requires the operator to leave the vehicle cab and, using a wrench, loosening a retaining bolt, turning a switch lever and then retightening the retaining bolt, to switch patterns. The switch lever is located behind a rear tire in a location exposed to dirt and mud.

The present inventors have recognized that to increase the utility of a work vehicle, it would be advantageous if different operators accustomed to different operating patterns of the work vehicle controls could select their preferred control pattern easily and quickly. The present inventors have recognized that it would be advantageous to provide a pattern switching arrangement that was more easily operable without requiring an operator to leave the operator's cab to make a pattern switch and without requiring the use of a tool to switch patterns.

SUMMARY OF THE INVENTION

The present invention provides an electrical/hydraulic system on a work vehicle that is usable by an operator to easily change control patterns of dual control levers that manipulate a work implement.

The present invention provides a control arrangement for controlling the operation of a work implement carried on a work vehicle. The arrangement includes a first control lever, a first hydraulic system, and a first hydraulic cylinder. The first control lever is operatively connected to the first hydraulic system. The first control lever is arranged to be moved by an operator alternately in a first direction or in a second direction, to control two-way movement of the first hydraulic cylinder by routing pressurized hydraulic fluid from the first hydraulic system to a respective extend or retract port of the first hydraulic cylinder.

The arrangement also includes a second control lever, a second hydraulic system, and a second hydraulic cylinder. The second control lever is operatively connected to the second hydraulic system. The second control lever is arranged to be moved by an operator alternately in a third direction or in a fourth direction, to control two-way movement of the second hydraulic cylinder by routing pressurized hydraulic fluid from the second hydraulic system to a respective extend or retract port of the second hydraulic cylinder.

The first and second hydraulic cylinders are configured and arranged to move or pivot different portions of a work implement of a work vehicle.

The arrangement also includes a control switch, at least one electrically operated valve block, and third and fourth hydraulic systems. In the preferred embodiment, the third and fourth hydraulic systems are comprised of a reconfiguration of the components that comprise the first and second hydraulic systems. The electrically-operated valve block is electrically connected to a source of power and to the control switch, and hydraulically connected to the first and second hydraulic systems such that changing the state of the control switch charges the state of the electrically operated valve block to operatively connect the first and second control levers to the third and fourth hydraulic systems respectively.

When the control switch changes the state of the electrically operated valve block, the first control lever is arranged to be moved by an operator alternately in the first direction or in the second direction, to control two-way movement of the second hydraulic cylinder by routing pressurized hydraulic fluid from the third hydraulic system to a respective extend or retract port of the second hydraulic cylinder. The second control lever is arranged to be moved by an operator alternately in the third direction or in the fourth direction, to control two-way movement of the first hydraulic cylinder by routing pressurized hydraulic fluid from the fourth hydraulic system to a respective extend or retract port of the first hydraulic cylinder.

Preferably the first and second directions are opposite directions, and the third and fourth directions are opposite directions.

The arrangement can include a third hydraulic cylinder arranged to move or pivot a third portion of the implement, and a fourth hydraulic cylinder arranged to move or pivot a fourth portion of the implement. The first control lever is operatively connected to either the first hydraulic system or the third hydraulic system. When the first control lever is operatively connected to either the first hydraulic system or the third hydraulic system, the first control lever is arranged to be moved by an operator alternately in a fourth direction or in a fifth direction that are different from the first and second directions, to control two-way movement of the third hydraulic cylinder by routing pressurized hydraulic fluid from either the first hydraulic system or the third hydraulic system to a respective extend or retract port of the third hydraulic cylinder. The second control lever is operatively connected to either the second or the fourth hydraulic system. When the second control lever is operatively connected to either the second hydraulic system or the fourth hydraulic system, the second control lever is arranged to be moved by an operator alternately in a seventh direction or in an eighth direction that are different from the third and fourth directions, to control two-way movement of the fourth hydraulic cylinder by routing pressurized hydraulic fluid from either the second hydraulic system or the fourth hydraulic system to a respective extend or retract port of the fourth hydraulic cylinder. The fifth and sixth directions are opposite directions and the seventh and eighth directions are opposite directions, and the fifth direction is perpendicular to the first direction and the seventh direction is perpendicular to the third direction.

The control switch is located within an operator's cab of the work vehicle, preferably wherein an operator can actuate the switch while seated in the operator's cab.

The electrically operated valve block comprises at least one solenoid valve, preferably two solenoid valves, each having a spool that is shifted by electrical power routed through the control switch.

The first hydraulic system comprises at least one first pilot operated valve hydraulically connected to a first spool valve that is hydraulically connected to the extend and retract ports of the first hydraulic cylinder. The third hydraulic system comprises the at least one first pilot operated valve hydraulically connected to a second spool valve that is hydraulically connected to the extend and retract ports of the second hydraulic cylinder. The at least one first pilot operated valve is mechanically adjusted by the first control lever.

The second hydraulic system comprises at least one second pilot operated valve hydraulically connected to the second spool valve that is hydraulically connected to the extend and retract ports of the second hydraulic cylinder. The fourth hydraulic system comprises the at least one second pilot operated valve hydraulically connected to the first spool valve that is hydraulically connected to the extend and retract ports of the first hydraulic cylinder. The at least one second pilot operated valve is mechanically adjusted by the second control lever.

The invention is advantageously applied to a backhoe having a swing frame, a boom, a dipperstick and a bucket. The swing frame is pivotally mounted to a supporting structure of a backhoe about a vertical pivot axis. The boom is pivotally coupled to the swing frame about a horizontal pivot axis. The dipperstick is pivotally mounted to the boom about a horizontal axis. The bucket is pivotally mounted to the dipperstick about a horizontal axis. The first hydraulic cylinder is connected between the boom and the swing frame. The second hydraulic cylinder is connected between the dipperstick and the boom. The third hydraulic cylinder is connected between the supporting structure and the swing frame. The fourth hydraulic cylinder is connected between the bucket and the dipperstick.

The present invention provides a control pattern selection arrangement for a work vehicle such as a backhoe loader employing two control levers. The arrangement permits an easy and quick control pattern change by an operator without leaving the operator's cab and without the use of a tool.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1:
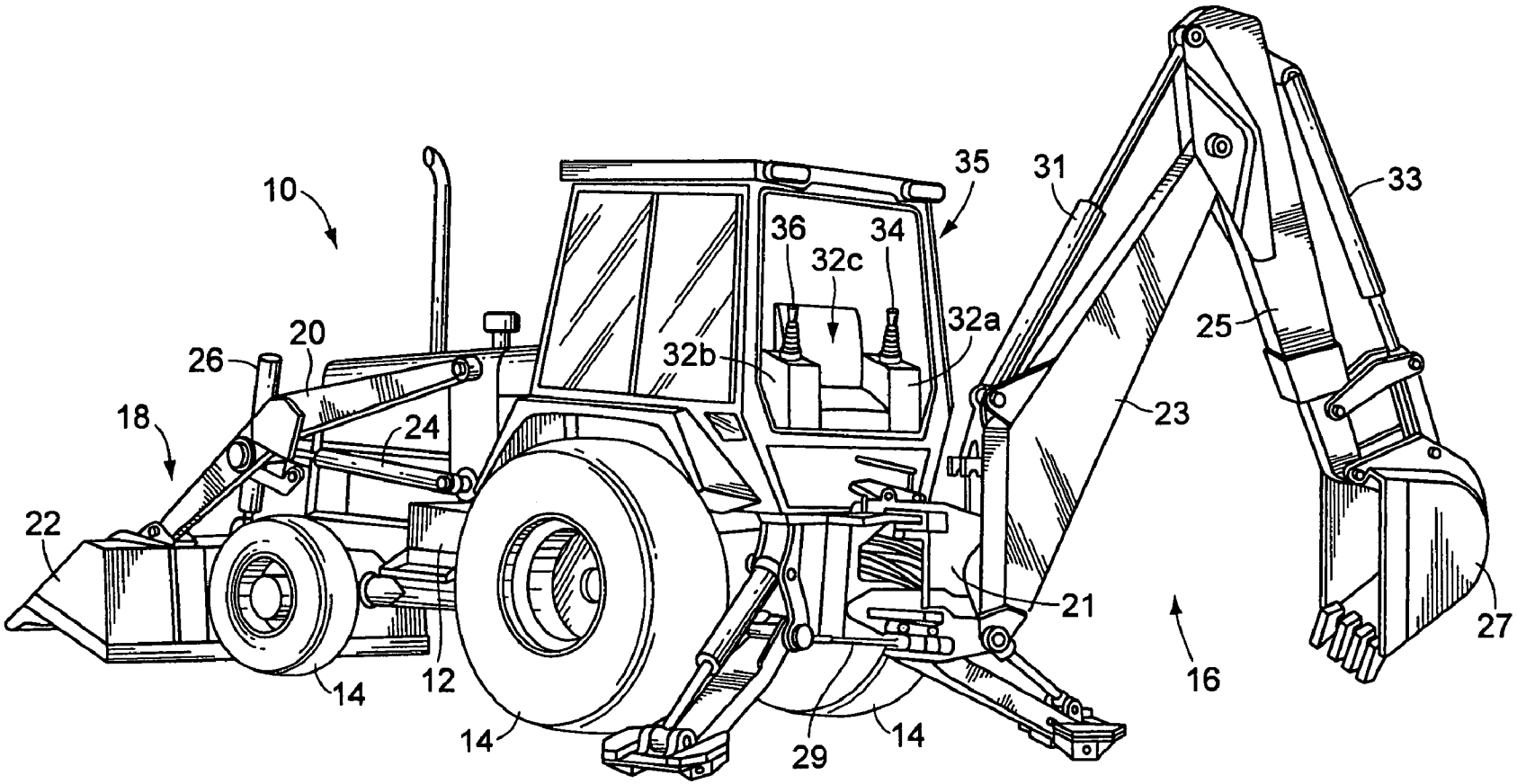
FIG. 1 is a rear perspective view of a backhoe loader having a cutaway rear window, illustrating left and right control levers on a control console.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

The work vehicle 10 illustrated in FIG. 1 is a backhoe loader. The work vehicle 10 is provided with a supporting structure 12 and ground engaging means 14 comprising wheels which support and propel the supporting structure 12. Although the ground engaging means 14 of the illustrated embodiment are wheels, the present invention could also be used on tracked work vehicles having steel or rubber tracks. The supporting structure 12 is provided with two work implements, a backhoe 16 and a loader 18.

The loader is mounted to the front of the supporting structure 12 and comprises lift arms 20, only one shown, and a bucket 22. The lift arms 20 are provided with lift arm hydraulic cylinders 24, only one shown, for lifting the arms 20 relative to the supporting structure 12. The bucket 22 is pivotally mounted to the end of the lift arms 20. Bucket 22 is provided with a bucket-tilt hydraulic cylinder 26 for tilting the bucket 22 relative to the lift arms 20.

The backhoe 16 is mounted to the rear of the supporting structure 12 and comprises a swing frame 21, a boom 23, a dipperstick 25 and a bucket 27. The swing frame 21 is pivotally mounted to the supporting structure 12 about a vertical pivot axis. Swing frame hydraulic cylinders 29, one on each side, only one visible, swing the swing frame 21. The boom 23 is pivotally coupled to the swing frame about a horizontal pivot and is raised and lowered by a hydraulic cylinder 30 (not visible in FIG. 1) internally mounted in the boom 23. The dipperstick 25 is pivotally mounted to the boom about a horizontal axis and is pivoted relative to the boom by dipperstick hydraulic cylinder 31. The bucket 27 is curled and uncurled relative to the dipperstick by bucket hydraulic cylinder 33.

Hydraulic control spools control the extension and retraction of the hydraulic cylinders. The hydraulic control spools are opened and closed by pilot operated control mechanisms located inside operator's cab 35. Left and right side consoles 32*a*, 32*b* are located in the operator's cab on opposite lateral sides of an operator's seat 32*c*. The control mechanisms are provided with two control levers 34 and 36 extending upwardly from the consoles 32*a*, 32*b*.

Each control lever 34 and 36 controls two functions by selectively positioning two hydraulic control spools described below. The control levers 34 and 36 can be moved in two orthogonal directions or control arcs, fore-and-aft and side-to-side. For example, according to the "backhoe pattern", moving the left-hand control lever 34 fore-and-aft lowers and raises the boom 23 by extending and retracting the internally mounted hydraulic cylinder 30. Moving left-hand control lever 34 side-to-side pivots the swing frame 21 by extending and retracting swing frame hydraulic cylinders 29.

Figure 2:
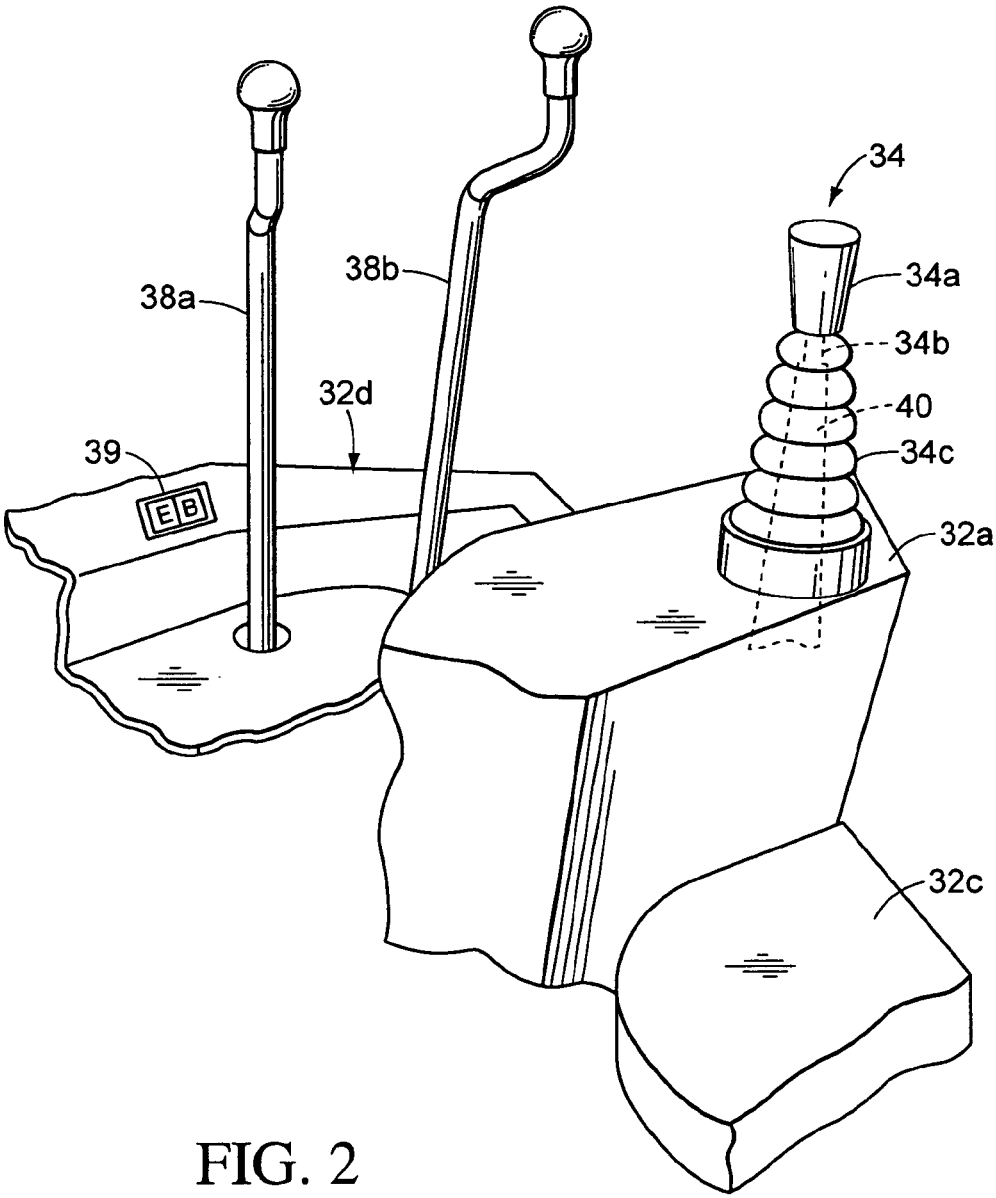
FIG. 2 is a fragmentary perspective view of inside an operator's cab of the work vehicle of FIG. 1.

FIG. 2 illustrates the control lever 34 extending upwardly from the console 32*a*. The lever 34 has a handle 34*a* mounted on a rod 34*b* and a flexible boot 34*c* surrounding the rod 34*b*. The lever 36 is identically configured, extending from the console 32*b*. To the left of the console 32*a* is a control panel 32*d*. Two stabilizer control levers 38*a*, 38*b* extend upwardly from the panel 32*d*. A pattern selector switch 39 is arranged on the panel 32*d*. An operator can reach and change the state of the switch 39 while seated on the seat 32*c* in the operator's cab 35. The switch is preferably a two position rocker switch marked with two indicia of selectable patterns. FIG. 2 simply indicates "B" and "E", as indicia for the backhoe and excavator patterns. A graphic pictorial of a backhoe and an excavator can be used as indicia for instant recognition by an operator.

Two pilot control valve assemblies 40, 42 (valve assembly 40 shown schematically in FIG. 2), corresponding to the control levers 34, 36 respectively, are used to control backhoe functions. The pilot control valve assemblies 40, 42 are located inside the respective boots 34*c* of the levers 34, 36 and partially inside the consoles 32*a*, 32*b*.

Figure 3:
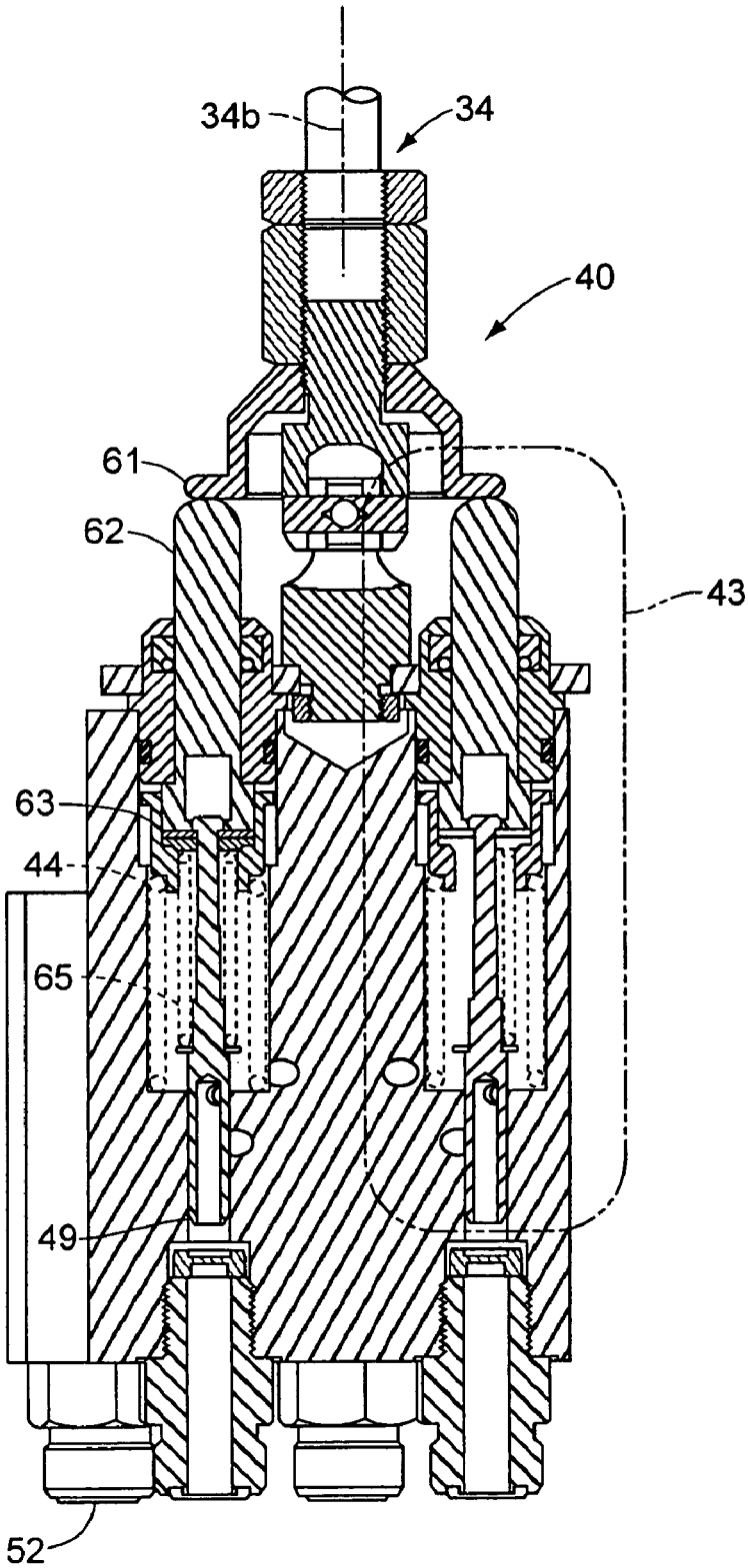
FIG. 3 is a fragmentary, schematic sectional view of one control lever.

FIG. 3 illustrates the pilot control valve assembly 40, the control valve assembly 42 being identically configured. Each control valve assembly includes four plunger assemblies 43, one for each direction of each function. Each plunger assembly corresponds to one valve spool 232, 234, 236, 238 as described below.

In neutral, with no other functions activated, return spring 44 holds the metering spool 49 closed. This blocks pressurized fluid from entering the work ports, allowing fluid to return to tank.

During operation, pilot pressure fluid from the pilot control manifold valve enters the pilot control valve at pressure port 52. Wobble plate 61 depresses plunger 62 contacting spring guide 63. The spring guide compresses both return spring 44 and metering (pressure control) spring 65. The compressed springs move metering spool 49 down to a metering position allowing fluid to flow out the connected workport. As workport pressure builds to meet spring force the metering spool moves between neutral and metered position maintaining commanded pressure. The pilot control valve assemblies 40, 42 are heretofore known as commercially available on the JOHN DEERE Models 310SG, 410G or 710G loader backhoes, available from Deere & Company, of Moline, Ill., USA.

Figure 4:
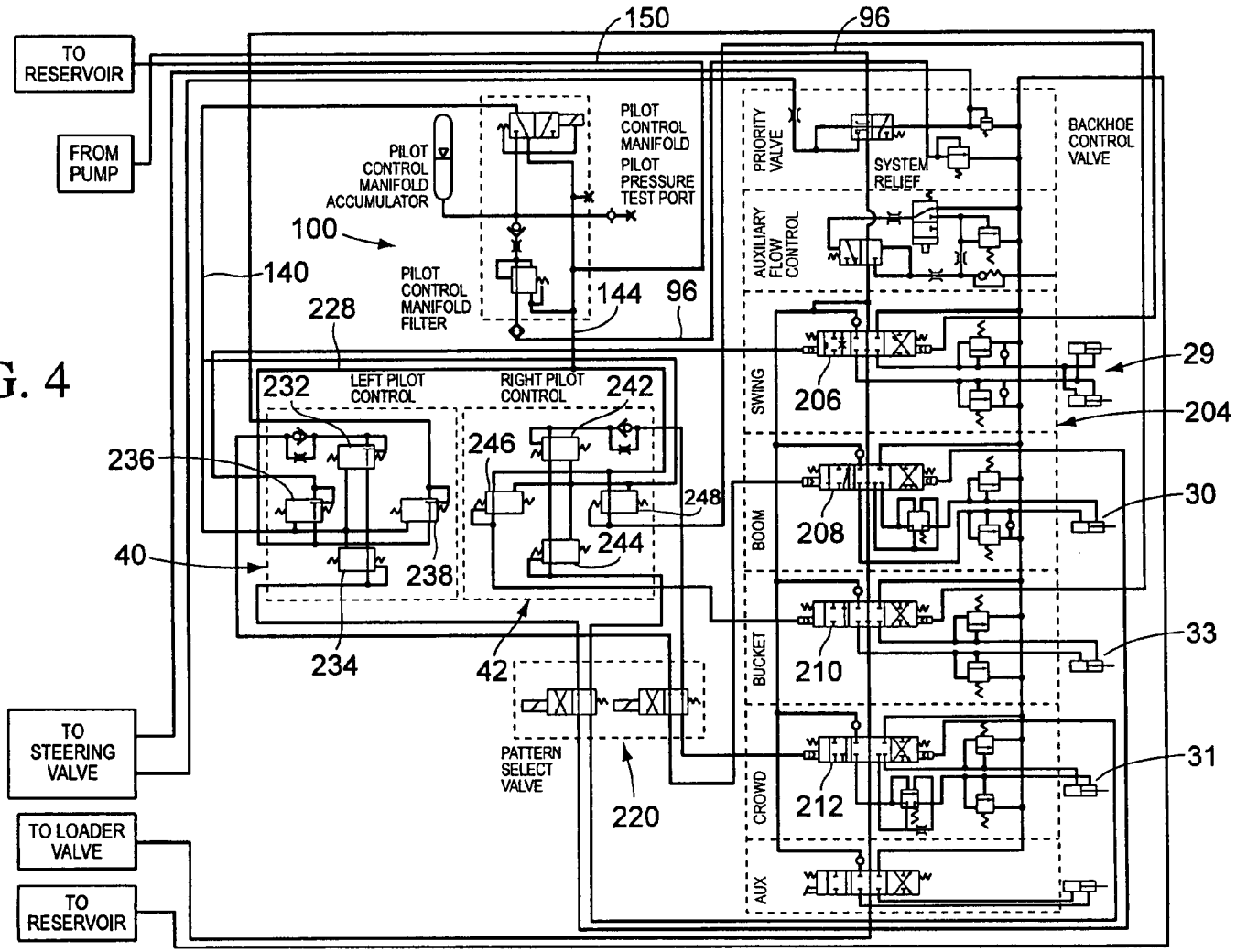
FIG. 4 is a schematic view of the hydraulic control of the backhoe functions of the backhoe loader of FIG. 1.
Figure 5:
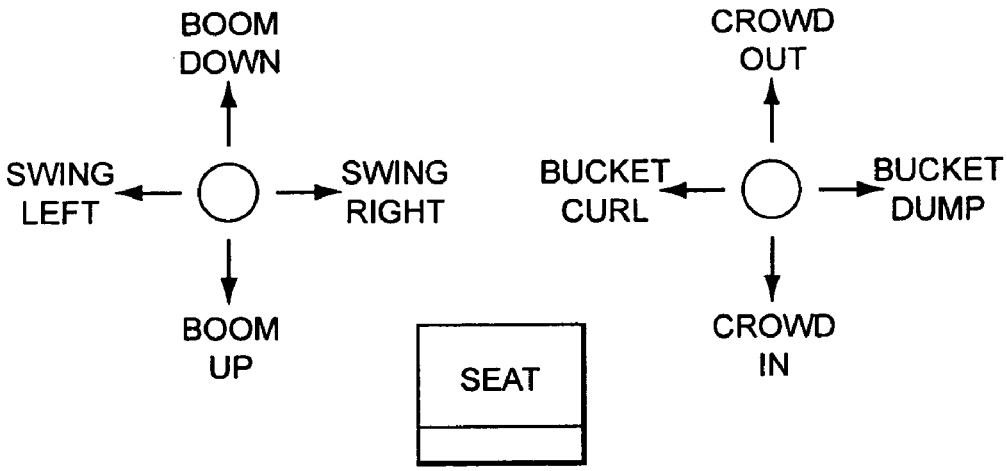
FIG. 5 PRIOR ART
FIG. 5 is a diagrammatic plan view showing the functions of movement of the left and right control levers.
Figure 5:
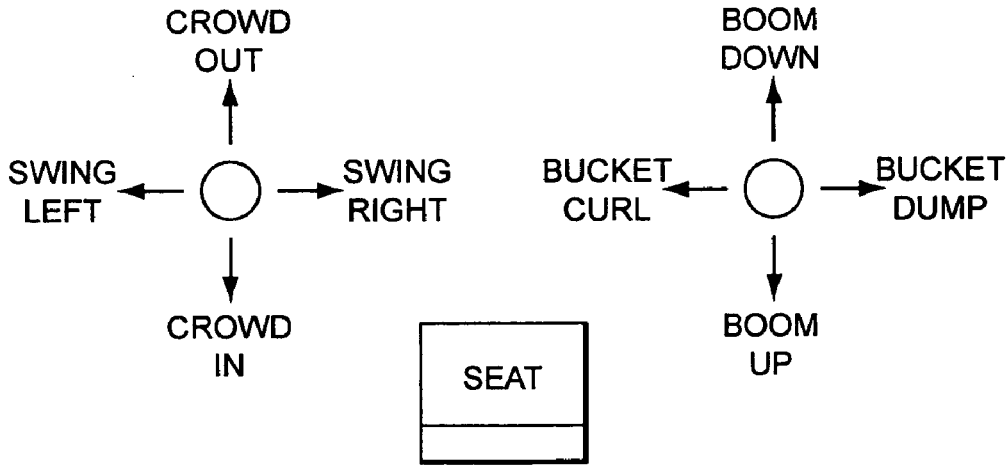
FIG. 5 PRIOR ART

FIG. 4 illustrates a hydraulic control system according to the invention. Except for the improvements set forth in the present invention, the hydraulic system is conventional and available on the JOHN DEERE Models 310SG, 410G or 710G loader backhoes. A more complete description of a like hydraulic system to control a hydraulic implement using pilot operated spool valves is described in U.S. Pat. No. 4,898,078, herein incorporated by reference.

Pressurized hydraulic fluid is provided via a line 96 to a fluid pressure reduction system 100. Hydraulic fluid having a reduced pressure is directed from pressure reduction system 100 to pilot control valve assemblies 40, 42 (FIG. 3), through supply line 140. Hydraulic fluid is returned from the pilot control assemblies 40, 42 to system 100 through return line 144.

Pressurized hydraulic fluid is directed to the working circuit through hydraulic line 150. The backhoe circuit comprises backhoe control valve 204 having four pilot controlled directional control spools 206, 208, 210 and 212. The directional control spools control the movement of the four hydraulic actuators, which include boom swing cylinders 29, boom-lift cylinder 30, dipperstick pivot cylinder 31 and bucket-tilt cylinder 33. All the control spools are positioned by the pilot control valve assemblies 40, 42.

The pilot control valve assemblies 40, 42 are hydraulically connected to the cylinders 30 and 31 through a pattern select valve 220. The pattern select valve is actuated to select either a "backhoe pattern" or an "excavator pattern" as described below. FIG. 4 shows the valve 220 in a state corresponding to a backhoe pattern.

The two pilot control valve assemblies 40, 42 hydraulically control the positioning of control spools 206, 208, 210, 212. Control spools 206, 208, 210, 212 are four-way, three position directional control spools. The control system provides hydraulic inputs to the sides of the control spools 206, 208, 210, 212 for hydraulically shifting the control spools. Hydraulic fluid from the pressure reduction system 100 is directed to the pilot control system through line 228 and hydraulic fluid is returned to the system 100 through return line 144.

The left side pilot control valve assembly 40 is provided with four, two-position valve spools 232, 234, 236 and 238 that are arranged in two opposed pairs. In the backhoe pattern, the first opposed pair of valve spools 232, 234 controls the positioning of boom-lift control spool 208, whereas the second opposed pair of valve spools 236, 238 control the positioning of the swing control spool 206. Fluid from line 228 is a shared hydraulic supply line to which each of the four valve spools 232, 234, 236, 238 is fluidly coupled. In addition, each of the four valve spools is fluidly coupled to return line 144.

The positioning of the four valve spools is manually controlled by the operator through a joystick arrangement, the control lever 34. As the control lever 34 is moved backward, spool 234 is positioned to direct hydraulic fluid from shared hydraulic line 228 to the right side of control valve spool 208. At the same time, valve spool 232 fluidly couples the left side of control spool 208 to return line 144. In this way, control spool 208 is moved to the left so that hydraulic fluid from supply line 96 retracts boom lift cylinder 30, raising the boom. If the lever 34 is moved forward, the roles of the valve spools 232, 234 are reversed and the control spool 208 shifts to the right and the boom lift cylinder 30 extends, lowering the boom. The swing cylinders 29 are controlled in a similar manner, by the left and right movement of the control lever 34. A left movement of the control lever 34 causes the valve spool 236 to direct hydraulic fluid from shared hydraulic line 228 to the right side of swing control spool 206 and at the same time the valve spool 238 fluidly couples the left side of the control spool 206 to the shared return line 144. The cylinders 29 move in opposite directions to swing the boom to the left. If the lever 34 is instead moved to the right, the roles of the valve spools 236, 238 are reversed, and the swing control spool 206 is shifted to the right and the cylinders 29 move in opposite directions to swing the boom to the right.

The right side pilot control valve assembly 42 is provided with four, two-position valve spools 242, 244, 246 and 248 that are arranged in two opposed pairs. In the backhoe pattern, the first opposed pair of valve spools 242, 244 controls the positioning of crowd control spool 212, whereas the second opposed pair of valve spools 246, 248 control the positioning of the bucket or curl control spool 210. Line 228 is a shared hydraulic supply line to which each of the four valve spools 242, 244, 246, 248 is fluidly coupled. In addition, each of the four valve spools 242, 244, 246, 248 is fluidly coupled to return line 144.

The positioning of the four valve spools 242, 244, 246, 248 is manually controlled by the operator through a joystick arrangement, the control lever 36. As the control lever 36 is moved backward, spool 244 is positioned to direct hydraulic fluid from shared hydraulic line 228 to the right side of control valve spool 212. At the same time, valve spool 242 fluidly couples the left side of control spool 212 to return line 144. In this way, control spool 212 is moved to the left so that hydraulic fluid from supply line 96 retracts crowd cylinder 31, raising the dipperstick 25. If the lever 36 is moved forward, the roles of the valve spools 242, 244 are reversed and the control spool 212 shifts to the right and the crowd cylinder 31 extends, lowering the dipperstick 25. The bucket cylinder 33 is controlled in a similar manner, by the left and right movement of the control lever 36. A left movement of the control lever 36 causes the valve spool 246 to direct hydraulic fluid from shared hydraulic line 228 to the left side of bucket control spool 210 and at the same time the valve spool 248 fluidly couples the right side of the control spool 210 to the shared return line 144. The cylinder 33 extends to curl in the bucket 27. If the lever 36 is instead moved to the right, the roles of the valve spools 246, 248 are reversed, and the bucket control spool 210 is shifted to the left and the cylinder 33 retracts to curl out the bucket 27.

Figure 6:
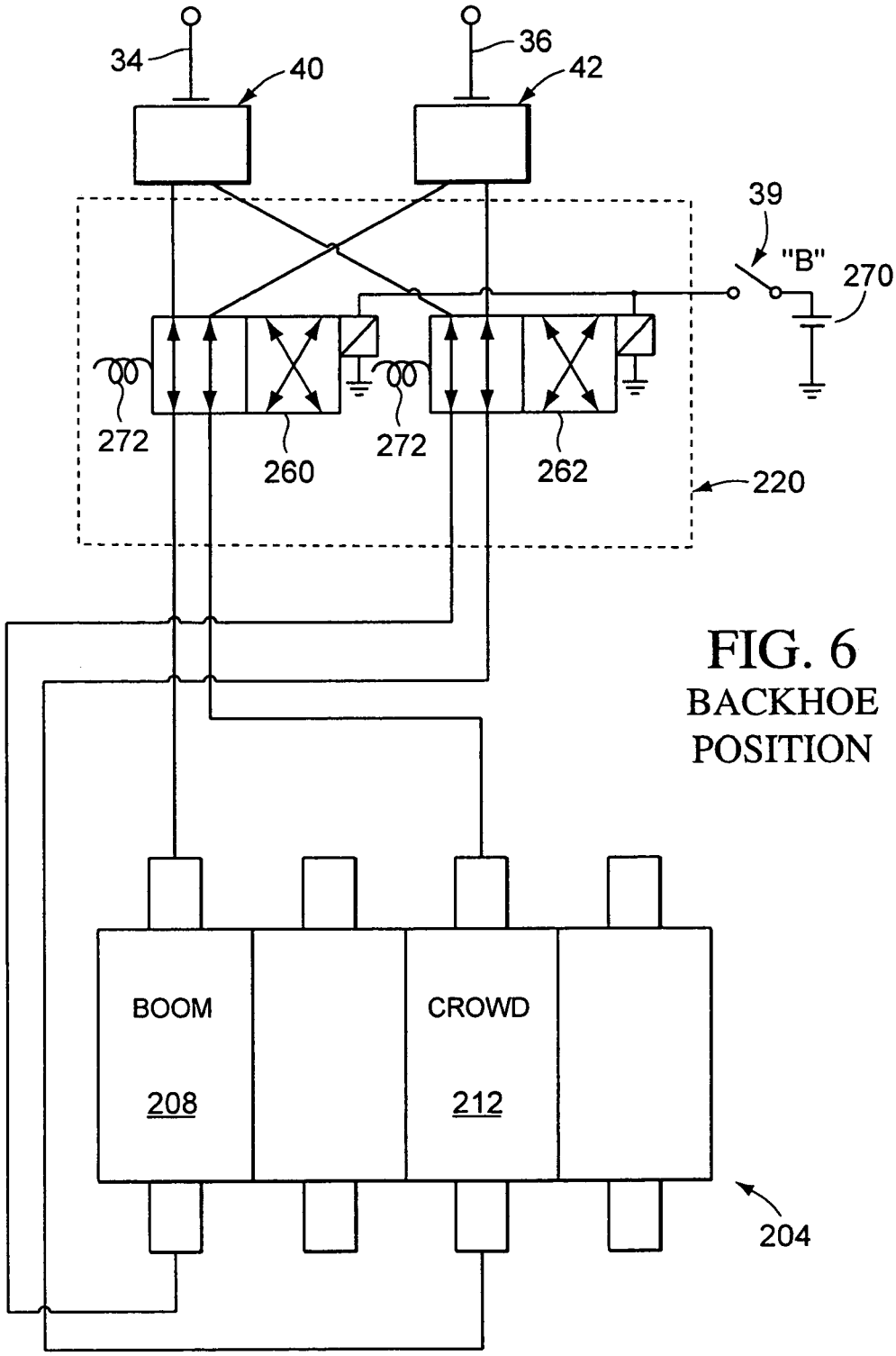
FIG. 6 is a schematic view of a portion of FIG. 4 in a backhoe select configuration.
Figure 7:
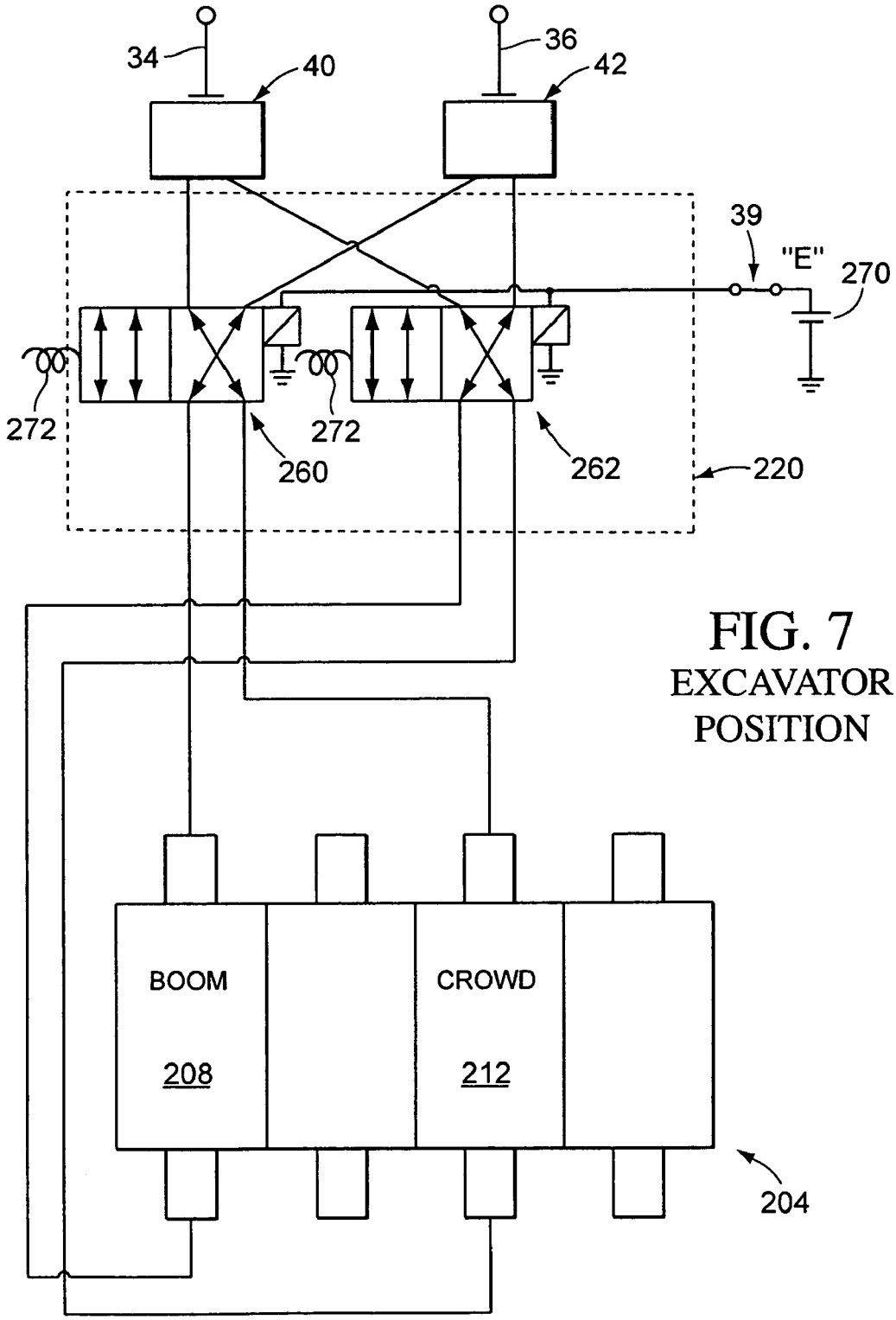
FIG. 7 is a schematic view of a portion of FIG. 4 in an excavator select configuration.

The pattern select valve 220 is used to switch from the backhoe pattern of FIGS. 4 and 6 to the excavator pattern of FIG. 7. To accomplish the switch, the location of the backhoe boom and crowd functions as between the levers 34, 36, are switched.

The pattern select valve 220 can include two, two-position four-way solenoid operated valves 260, 262. These valves are controlled by the two-position pattern select switch 39. The switch 39 is connected to a source of electrical power 270 from the vehicle electrical system. The source of electrical powers is simplified in the schematic as a battery, but could utilize a relay, a fuse and/or other electronics as known for vehicle electrical switching.

As shown in FIG. 6, with pattern select switch 39 in backhoe position "B", both solenoid valves 260, 262 are de-energized and solenoid springs 272 shift the solenoid valves to the right. This configures the hydraulic system to control boom lift cylinder 30 with the left control lever 34 and crowd cylinder 31 with the right control lever 36.

As shown in FIG. 7, with pattern select switch 39 in excavator position "E", both solenoid valves are energized and act to shift the solenoid valves 260, 262 to the left, overcoming force from the solenoid springs 272. This directs oil to control the boom lift cylinder 30 with the right control lever 36 and the crowd cylinder 31 with the left control lever 34.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A control arrangement for controlling the operation of a work implement carried on a work vehicle, comprising:

a first control lever, a first hydraulic system, and a first hydraulic cylinder, said first control lever operatively connected to said first hydraulic system, said first control lever arranged to be moved by an operator in a first direction or in a second direction, to control two-way movement of said first hydraulic cylinder by routing pressurized hydraulic fluid from said first hydraulic system to a respective extend or retract port of said first hydraulic cylinder;

a second control lever, a second hydraulic system, and a second hydraulic cylinder, said second control lever operatively connected to said second hydraulic system, said second control lever arranged to be moved by an operator in a third direction or in a fourth direction, to control two-way movement of said second hydraulic cylinder by routing pressurized hydraulic fluid from said second hydraulic system to a respective extend or retract port of said second hydraulic cylinder;

said first and second hydraulic cylinders configured and arranged to position different portions of a work implement of a work vehicle;

third and fourth hydraulic systems;

a control switch and at least one electrically operated valve block, said electrically-operated valve block electrically connected to a source of power and to said control switch, and hydraulically connected to said first and second hydraulic systems such that changing the state of said control switch charges the state of said electrically operated valve block to operatively connect said first and second control levers to said third and fourth hydraulic systems respectively, wherein said first control lever is arranged to be moved by an operator in said first direction or in said second direction, to control two-way movement of said second hydraulic cylinder by routing pressurized hydraulic fluid from said third hydraulic system to a respective extend or retract port of said second hydraulic cylinder, and wherein said second control lever is arranged to be moved by an operator in said third direction or in said fourth direction, to control two-way movement of said first hydraulic cylinder by routing pressurized hydraulic fluid from said fourth hydraulic system to a respective extend or retract port of said first hydraulic cylinder.

2. The control arrangement according to claim 1, wherein said third and fourth hydraulic systems comprise reconfigured, common hydraulic components with said first and second hydraulic systems.

3. The control arrangement according to claim 1, wherein said first and second directions are opposite directions, and said third and fourth directions are opposite directions.

4. The control arrangement according to claim 1, further comprising a third hydraulic cylinder arranged to position a third portion of said implement, and a fourth hydraulic cylinder arranged to position a fourth portion of said implement, wherein when said first control lever is operatively connected to either said first hydraulic system or said third hydraulic system, said first control lever is arranged to be moved by an operator in a fourth direction or in a fifth direction that are different from said first and second directions, to control two-way movement of said third hydraulic cylinder by routing pressurized hydraulic fluid from either said first hydraulic system or said third hydraulic system to a respective extend or retract port of said third hydraulic cylinder; and wherein when said second control lever is operatively connected to either said second hydraulic system or said fourth hydraulic system, said second control lever is arranged to be moved by an operator in a seventh direction or in an eighth direction that are different from said third and fourth directions, to control two-way movement of said fourth hydraulic cylinder by routing pressurized hydraulic fluid from either said second hydraulic system or said fourth hydraulic system to a respective extend or retract port of said fourth hydraulic cylinder;

wherein said fifth and sixth directions are opposite directions and said seventh and eighth directions are opposite directions, and said fifth direction is perpendicular to said first direction and said seventh direction is perpendicular to said third direction.

5. The control arrangement according to claim 4, wherein said work implement is a backhoe having a swing frame, a boom, a dipperstick and a bucket, the swing frame being pivotally mounted to a supporting structure about a vertical pivot axis, the boom being pivotally coupled to the swing frame about a horizontal pivot axis, the dipperstick is pivotally mounted to the boom about a horizontal axis, the bucket is pivotally mounted to the dipperstick about a horizontal axis, wherein said first hydraulic cylinder is connected between said boom and said swing frame, said second hydraulic cylinder is connected between said dipperstick and said boom, said third hydraulic cylinder is connected between said supporting structure and said swing frame, and said fourth hydraulic cylinder is connected between said bucket and said dipperstick.

6. The control arrangement according to claim 1, wherein said work implement is a backhoe having a swing frame, a boom, a dipperstick and a bucket, the swing frame being pivotally mounted to a supporting structure about a vertical pivot axis, the boom being pivotally coupled to the swing frame about a horizontal pivot axis, the dipperstick is pivotally mounted to the boom about a horizontal axis, the bucket is pivotally mounted to the dipperstick about a horizontal axis, wherein said first hydraulic cylinder is connected between said boom and said swing frame, said second hydraulic cylinder is connected between said dipperstick and said boom.

7. The control arrangement according to claim 1, wherein said work vehicle comprises an operator's cab wherein said operator can operate said first and second levers, and wherein said control switch is located within said operator's cab of said work vehicle.

8. The control arrangement according to claim 1, wherein said electrically operated valve block comprises at least one solenoid valve having a spool that is shifted by electrical power routed through said control switch.

9. The control arrangement according to claim 1, wherein said first hydraulic system comprises at least one first pilot operated valve hydraulically connected to a first spool valve that is hydraulically connected to said extend and retract ports of said first hydraulic cylinder, and said third hydraulic system comprises said at least one first pilot operated valve hydraulically connected to a second spool valve that is hydraulically connected to said extend and retract ports of said second hydraulic cylinder, said at least one first pilot operated valve mechanically adjusted by said first control lever, wherein said second hydraulic system comprises at least one second pilot operated valve hydraulically connected to said second spool valve that is hydraulically connected to said extend and retract ports of said second hydraulic cylinder, and said fourth hydraulic system comprises said at least one second pilot operated valve hydraulically connected to said first spool valve that is hydraulically connected to said extend and retract ports of said first hydraulic cylinder, said at least one second pilot operated valve mechanically adjusted by said second control lever.

10. A work vehicle having a backhoe, the backhoe having a pivotal boom, a dipperstick pivotally connected to the boom, and a bucket, comprising:

a first control lever, a first hydraulic system, and a first hydraulic cylinder, said first control lever operatively connected to said first hydraulic system, said first control lever arranged to be moved by an operator in a first direction or in a second direction, to control two-way movement of said first hydraulic cylinder by routing pressurized hydraulic fluid from said first hydraulic system to a respective extend or retract port of said first hydraulic cylinder;

a second control lever, a second hydraulic system, and a second hydraulic cylinder, said second control lever operatively connected to said second hydraulic system, said second control lever arranged to be moved by an operator in a third direction or in a fourth direction, to control two-way movement of said second hydraulic cylinder by routing pressurized hydraulic fluid from said second hydraulic system to a respective extend or retract port of said second hydraulic cylinder;

said first and second hydraulic cylinders configured and arranged to pivot said boom and said dipperstick respectively;

third and fourth hydraulic systems;

a control switch and at least one electrically operated valve block, said electrically-operated valve block electrically connected to a source of power and to said control switch, and hydraulically connected to said first and second hydraulic systems such that changing the state of said control switch charges the state of said electrically operated valve block to operatively connect said first and second control levers to said third and fourth hydraulic systems respectively, wherein said first control lever is arranged to be moved by an operator in said first direction or in said second direction, to control two-way movement of said second hydraulic cylinder by routing pressurized hydraulic fluid from said third hydraulic system to a respective extend or retract port of said second hydraulic cylinder, and wherein said second control lever is arranged to be moved by an operator in said third direction or in said fourth direction, to control two-way movement of said first hydraulic cylinder by routing pressurized hydraulic fluid from said fourth hydraulic system to a respective extend or retract port of said first hydraulic cylinder.

11. The work vehicle according to claim 10, wherein said third and fourth hydraulic systems comprise reconfigured, common hydraulic components with said first and second hydraulic systems.

12. The work vehicle according to claim 10, wherein said first and second directions are opposite directions, and said third and fourth directions are opposite directions.

13. The work vehicle according to claim 10, wherein said boom is pivotally connected to a swing frame about a horizontal axis, said swing frame is pivotally connected to said work vehicle about a vertical axis, further comprising a third hydraulic cylinder arranged to move swing said swing frame, and wherein said bucket is pivotally connected to said dipperstick, further comprising a fourth hydraulic cylinder arranged to curl and uncurl said bucket, wherein when said first control lever is operatively connected to either said first hydraulic system or said third hydraulic system, said first control lever is arranged to be moved by an operator in a fourth direction or in a fifth direction that are different from said first and second directions, to control two-way movement of said third hydraulic cylinder by routing pressurized hydraulic fluid from either said first hydraulic system or said third hydraulic system to a respective extend or retract port of said third hydraulic cylinder;

wherein when said second control lever is operatively connected to either said second hydraulic system or said fourth hydraulic system, said second control lever is arranged to be moved by an operator in a seventh direction or in an eighth direction that are different from said third and fourth directions, to control two-way movement of said fourth hydraulic cylinder by routing pressurized hydraulic fluid from either said second hydraulic system or said fourth hydraulic system to a respective extend or retract port of said fourth hydraulic cylinder; and wherein said fifth and sixth directions are opposite directions and said seventh and eighth directions are opposite directions, and said fifth direction is perpendicular to said first direction and said seventh direction is perpendicular to said third direction.

14. The work vehicle according to claim 10, wherein said work vehicle comprises an operator's cab wherein said operator can operate said first and second levers, and wherein said control switch is located within said operator's cab of said work vehicle.

15. The work vehicle according to claim 10, wherein said electrically operated valve comprises at least one solenoid valve having a spool that is shifted by electrical power routed through said control switch.

16. The work vehicle according to claim 10, wherein said first hydraulic system comprises at least one first pilot operated valve hydraulically connected to a first spool valve that is hydraulically connected to said extend and retract ports of said first hydraulic cylinder, and said third hydraulic system comprises said at least one first pilot operated valve hydraulically connected to a second spool valve that is hydraulically connected to said extend and retract ports of said second hydraulic cylinder, said at least one first pilot operated valve mechanically adjusted by said first control lever, wherein said second hydraulic system comprises at least one second pilot operated valve hydraulically connected to said second spool valve that is hydraulically connected to said extend and retract ports of said second hydraulic cylinder, and said fourth hydraulic system comprises said at least one second pilot operated valve hydraulically connected to said first spool valve that is hydraulically connected to said extend and retract ports of said first hydraulic cylinder, said at least one second pilot operated valve mechanically adjusted by said second control lever.

17. The work vehicle according to claim 16, wherein said work vehicle comprises an operator's cab wherein said operator can operate said first and second levers, and wherein said control switch is located within said operator's cab of said work vehicle.

18. The work vehicle according to claim 17, wherein said electrically operated valve block comprises at least one solenoid valve having a spool that is shifted by electrical power routed through said control switch.

19. The work vehicle according to claim 17, wherein said work vehicle comprises an operator's seat within said operator's cab and wherein said operator can operate said first and second levers while seated in said seat, and wherein said control switch is located within said operator's cab of said work vehicle sufficiently close to said operator's seat such that an operator can reach said switch while seated in said seat.

* * * * *